US011035356B2

(12) United States Patent
Fitzner et al.

(10) Patent No.: US 11,035,356 B2
(45) Date of Patent: Jun. 15, 2021

(54) HIGH PRESSURE PUMP AND METHOD FOR COMPRESSING A FLUID

(71) Applicants: HYUNDAI MOTOR COMPANY, Seoul (KR); KIA MOTORS CORPORATION, Seoul (KR)

(72) Inventors: Stephan Fitzner, Langen (DE); Alexander Settle, Ruesselsheim (DE)

(73) Assignees: HYUNDAI MOTOR COMPANY, Seoul (KR); KIA MOTORS CORPORATION, Seoul (KR)

( * ) Notice: Subject to any disclaimer, the term of this patent is extended or adjusted under 35 U.S.C. 154(b) by 105 days.

(21) Appl. No.: 16/255,440

(22) Filed: Jan. 23, 2019

(65) Prior Publication Data

US 2020/0116141 A1 Apr. 16, 2020

(30) Foreign Application Priority Data

Oct. 15, 2018 (DE) ..... 102018217644.2

(51) Int. Cl.

| | |
|---|---|
| ***F04B 49/035*** | (2006.01) |
| ***F04B 45/02*** | (2006.01) |
| ***F04B 49/24*** | (2006.01) |
| ***F04B 39/12*** | (2006.01) |
| ***F04B 1/0408*** | (2020.01) |
| ***F02M 59/36*** | (2006.01) |
| ***F02M 55/04*** | (2006.01) |
| ***F04B 41/06*** | (2006.01) |

(Continued)

(52) U.S. Cl.

CPC ..... *F04B 49/035* (2013.01); *F02M 55/04* (2013.01); *F02M 59/366* (2013.01); *F02M 59/367* (2013.01); *F04B 1/0408* (2013.01); *F04B 39/123* (2013.01); *F04B 45/02* (2013.01); *F04B 49/243* (2013.01); *F02M 59/462* (2013.01); *F04B 39/1066* (2013.01); *F04B 41/06* (2013.01)

(58) Field of Classification Search

CPC .... F04B 43/107; F04B 49/243; F04B 1/0408; F04B 49/035; F04B 39/123; F04B 45/02; F02M 55/04; F02M 59/102; F02M 59/366; F02M 59/462; F02M 59/367; F02M 59/442; F02M 63/0225

See application file for complete search history.

(56) References Cited

U.S. PATENT DOCUMENTS 3,492,946 A * 2/1970 Martin
3,597,120 A * 8/1971 Reed (Continued)

FOREIGN PATENT DOCUMENTS

DE 695837 C 9/1940
DE 202011107909 U1 11/2011

*Primary Examiner* — Peter J Bertheaud
(74) *Attorney, Agent, or Firm* — McDonnell Boehnen Hulbert & Berghoff LLP

(57) ABSTRACT

A high pressure pump is disclosed. The high pressure pump comprises a compression chamber having an inlet for connecting to a fluid supply to intake a fluid, and an outlet, an inlet check valve between the compression chamber and the inlet, a digital inlet valve between the compression chamber and the inlet check valve, a variable volume chamber connected to the compression chamber through a manifold and the digital inlet valve, and a plunger or piston configured to compress the fluid in the compression chamber and the variable volume chamber.

5 Claims, 8 Drawing Sheets

(51) Int. Cl.
*F02M 59/46* (2006.01)
*F04B 39/10* (2006.01)

(56) References Cited

U.S. PATENT DOCUMENTS 7,604,462 B2 * 10/2009 Inoue ..... F04B 5/00
417/53
7,665,976 B2 * 2/2010 Usui ..... F02M 59/442
417/470
7,677,872 B2 * 3/2010 Beardmore ..... F04B 49/035
417/569

* cited by examiner

HIGH PRESSURE PUMP AND METHOD FOR COMPRESSING A FLUID

CROSS-REFERENCE TO RELATED APPLICATIONS

Pursuant to 35 U.S.C. § 119(a), this application claims priority to German Patent Application No. 102018217644.2, filed on Oct. 15, 2018, the contents of which is hereby incorporated by reference herein in its entirety.

TECHNICAL FIELD

This application relates to a high pressure pump and a method for compressing a fluid to an injection system, in particular to a high pressure pump and a method for direct injection type of internal combustion engine.

BACKGROUND

For internal combustion engines of vehicles, high pressure pumps have been used to pressurize fuel up to 350 bar with a fuel flow of up to 100 liters per hour (L/h) for fuel injection systems. Such a fuel pump is called a plunger pump, and is driven by a camshaft. A feed pressure of about 3.5-5 bar is required to fill a compression chamber in the pump through a digital inlet valve, especially at high engine speed and therewith plunger speed. To increase feed pressure to the level from atmospheric pressure, an additional pump or a pre-supply pump has been used.

FIGS. 5A to 5C show schemes of a prior art high pressure pump 200. When a plunger or piston 220 moves down (suction stroke), it causes suction of a fluid 206 from an inlet 204 through a digital inlet valve 214 and filling a compression chamber 202, as shown in FIG. 5A. After reaching the bottom dead center, the plunger or piston 220 moves up (compression stroke) as shown in FIG. 5B and some fluid is forced through the digital inlet valve 214 against the feed pressure of about 5 bar, leading to supply flow pulsation. When the digital inlet valve 214 closes as shown in FIG. 5C, the plunger or piston 220 compresses the remaining fluid 206 in the compression chamber 202 to a pressure slightly above a rail pressure in a common rail where the fluid 206 is stored for the injection system, and discharges the fluid 206 through an outlet check valve 210 to an outlet 208 until the plunger or piston 220 reaches the top dead center.

A periodic fuel flow created by plunger pumping strokes and an actuation of the digital inlet valve causes a periodic pressure pulsation. The periodic pressure pulsation influences a filling behavior of the compression chamber. Therefore, a damper membrane has previously been used to suppress the periodic pressure pulsation.

A spring has been used to keep the plunger in contact with a cam lobe even at high frequencies, however the constant and necessary spring preload causes cam drive load, friction, and wear, leading to an additional fuel consumption.

A plunger seal has been used to prevent the fuel from leaking to a cam side. However, the plunger seal causes friction and wear of the plunger, leading to fuel pollution or dilution by lubrication oil used in the cam side, which is responsible for engine wear and injector coking.

DE 20 2011 107 909 U1 describes a pistonless engine and variable combustion chamber geometry, characterized in that the engine has an elastic chamber jacket in which a bottom plate instead of a usual piston is firmly integrated whereby a friction-free volume change of a closed space is possible.

DE 695837 C describes a combustion pressure driven fuel pump comprising a large piston stage and an elastic spring piston.

It is an object of the disclosure to achieve an improved pump performance and efficiency in a cost-effective manner, in particular without using a plunger seal, a spring, and a damper membrane.

SUMMARY

One embodiment of the present disclosure is a combination of a compression chamber and a variable volume chamber in a high pressure pump. This combination allows for a stable supply of a fluid to the compression chamber, improved cam contact and sealing property to prevent fuel pollution or dilution, as well as reduction of feeding pressure for the high pressure pump.

According to an embodiment, the variable volume chamber comprises, or consists of a bellows. Thus the variable volume chamber may advantageously expand and shrink like a spring due to the flexibility of its structure.

According to an embodiment, the bellows comprises, or is made of, a metal or a plastic material. Metal is advantageous since it renders the bellows sturdy. Plastic is advantageous because it makes lightweight.

According to an embodiment, the manifold comprises a conduit, the conduit having a first end fluidically connected to the variable volume chamber and a second end fluidically connected between the inlet check valve and the digital inlet valve. This allows to connect the compression chamber and the variable volume chamber fluidically through the digital inlet valve.

According to an embodiment, the manifold comprises at least two separate conduits. This is advantageous for a smooth fluid exchange between the compression chamber and the variable volume chamber through the digital inlet valve.

According to an embodiment, the high pressure pump further comprises a safety valve between the compression chamber and the variable volume chamber or between the compression chamber and the manifold configured to control the pressure in the compression chamber to prevent overboost. Therefore, the reliability of the high pressure pump can be improved.

According to an embodiment, the high pressure pump further comprises a control unit to provide electrical control of the digital inlet valve. Therefore, one can control the digital inlet valve precisely.

According to an embodiment, a method of compressing a fluid is provided. The method comprises the steps of:

- connecting a fluid supply to a compression chamber, the compression chamber having an inlet, an outlet, an inlet check valve and a digital inlet valve, the compression chamber being connected to a variable volume chamber through a manifold and the digital inlet valve,
- driving a plunger or piston in a reciprocating motion, and
- compressing the fluid in the compression chamber and the variable volume chamber by the plunger or piston such that compressed fluid is discharged from the compression chamber through the outlet. This method allows supplying a fluid to the compression chamber stably, improved cam contact and sealing property, as well as reduction of the necessary feeding pressure for the high pressure pump.

According to an embodiment, the method of compressing a fluid further comprises the following steps: providing a safety valve between the compression chamber and the variable volume chamber or between the compression chamber and the manifold, and releasing an overboost into the variable volume chamber or the manifold by the safety valve if the overboost occurs. This allows for preventing an overboost in the compression chamber.

According to an embodiment, the method of compressing a fluid further comprises the following step: controlling the digital inlet valve electrically. This allows controlling the digital inlet valve.

According to an embodiment, feeding pressure of the fluid supply is less than 1 bar. This allows reducing the power consumption of an additional pump or the pre-supply pump to feed the fluid into the high pressure pump, leading to a reduction of fuel consumption.

According to an embodiment of the method of compressing a fluid, the flow rate of the fluid from the supply is less than 100 L/h. This also allows reducing the power consumption of the additional pump or the pre-supply pump to feed the fluid into the high pressure pump, lowering the fuel consumption.

BRIEF DESCRIPTION OF THE FIGURES

Exemplary aspects are illustrated in the drawings. It is intended that the embodiments and figures disclosed herein are to be considered illustrative rather than restrictive.

DETAILED DESCRIPTION

Figure 1A:
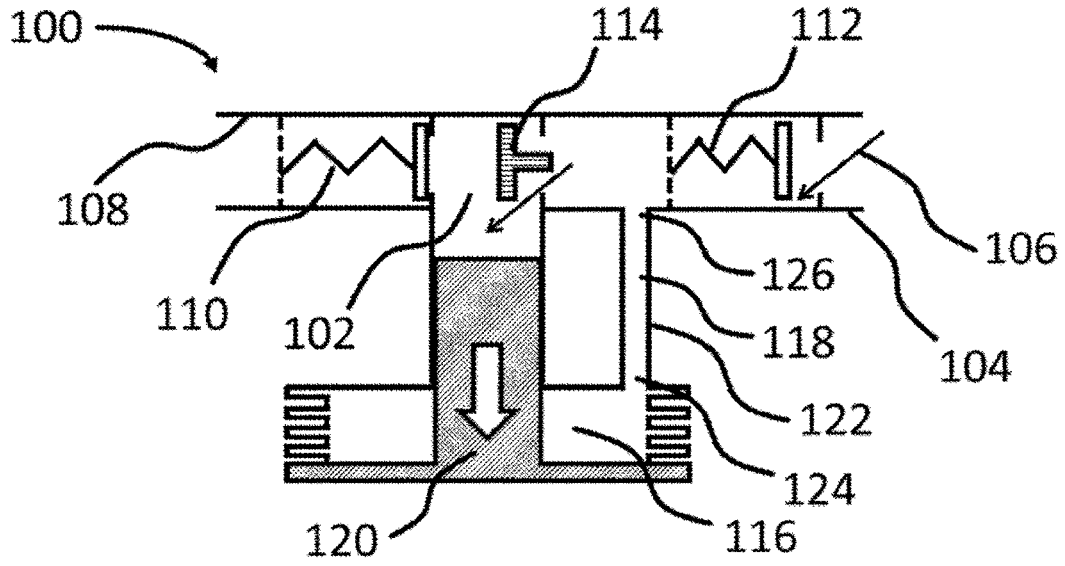
FIGS. 1A, 1B, 1C, 1D, 1E, and 1F are schematic drawings of one embodiment of a high pressure pump in accordance with an embodiment.

Although specific embodiments have been illustrated and described herein, it will be appreciated by those of ordinary skill in the art that a variety of alternate and/or equivalent implementations may be substituted for the specific embodiments shown and described without departing from the scope of the present disclosure. Generally, this application is intended to cover any adaptations or variations of the specific embodiments discussed herein.

According to a first embodiment, as illustrated in FIGS. 1A to 1F, a high pressure pump 100 comprises a compression chamber 102 having an inlet 104 for connecting to a fluid supply to intake a fluid 106, and an outlet 108, an inlet check valve 112 between the compression chamber 102 and the inlet 104, a digital inlet valve 114 between the compression chamber 102 and the inlet check valve 112, a variable volume chamber 116 connected to the compression chamber 102 through a manifold 118 and the digital inlet valve 114, and a plunger or piston 120 configured to compress the fluid 106 in the compression chamber 102 and the variable volume chamber 116.

The fluid 106 may be a liquid, in particular, a fuel, such as diesel or gasoline or the like.

FIG. 1A shows that opening the digital inlet valve 114, when the plunger or piston 120 moves down (suction stroke) to the bottom dead center, it causes suction of the fluid 106 through the inlet check valve 112.

Figure 1B:
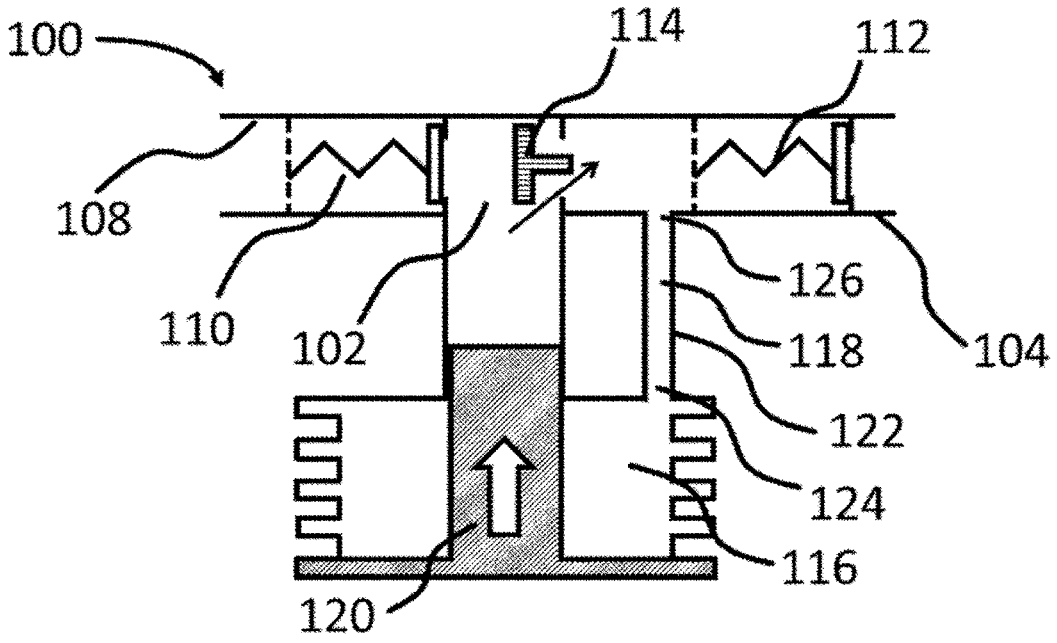
Figure 1C:
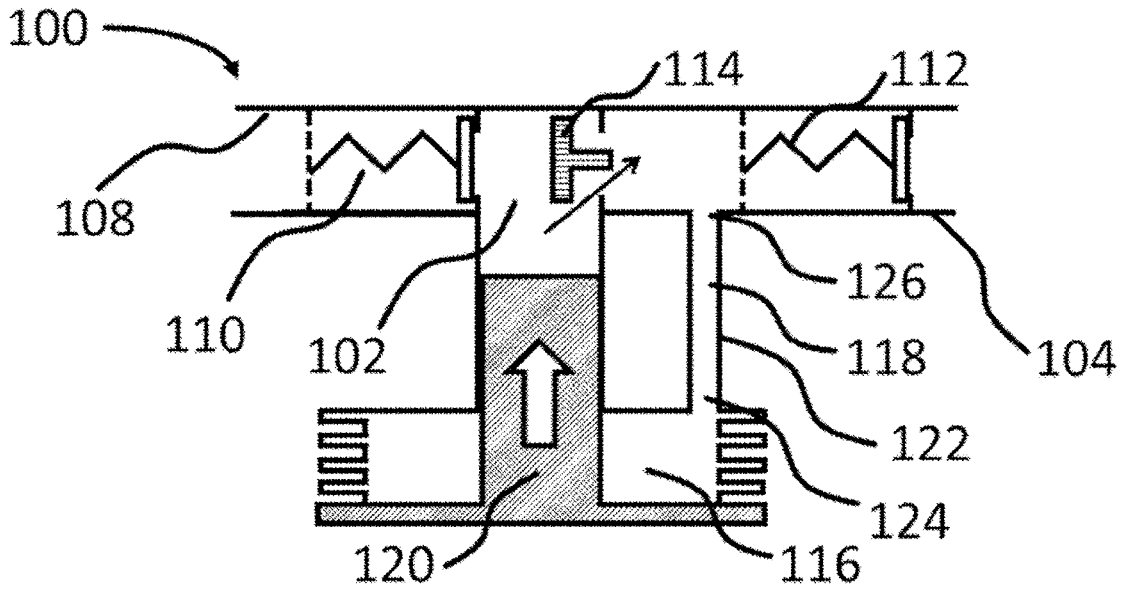

As shown in FIGS. 1B and 1C, when the plunger or piston 120 moves up (compression stroke), the inlet check valve 112 closes and the pressure in the compression chamber 102, manifold 118 and variable volume chamber 116 increases. Therefore, supply flow pulsation due to a back flow against the feed flow (FIG. 4B) can be avoided.

Figure 1D:
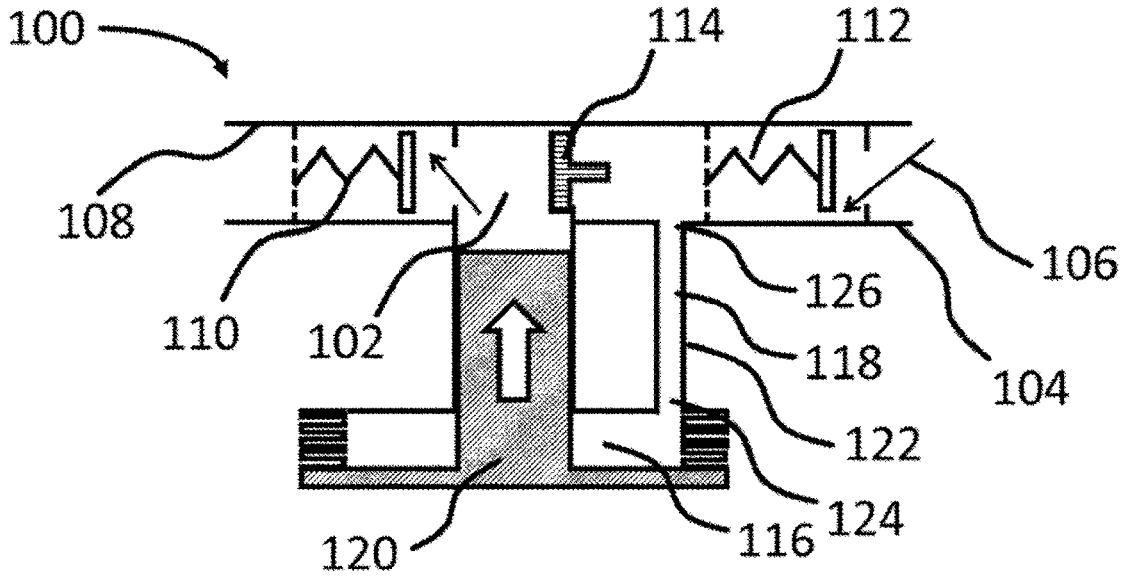

When the digital inlet valve 114 closes as shown in FIG. 1D, the pressure in the manifold 118 and variable volume chamber 116 reaches about 5 bar, for example, and the pressure in the compression chamber 102 reaches slightly above a rail pressure level in the injection system and discharges the fluid 106 through the outlet check valve 110 to the outlet 108 until the plunger or piston 120 reaches the top dead center.

Figure 1E:
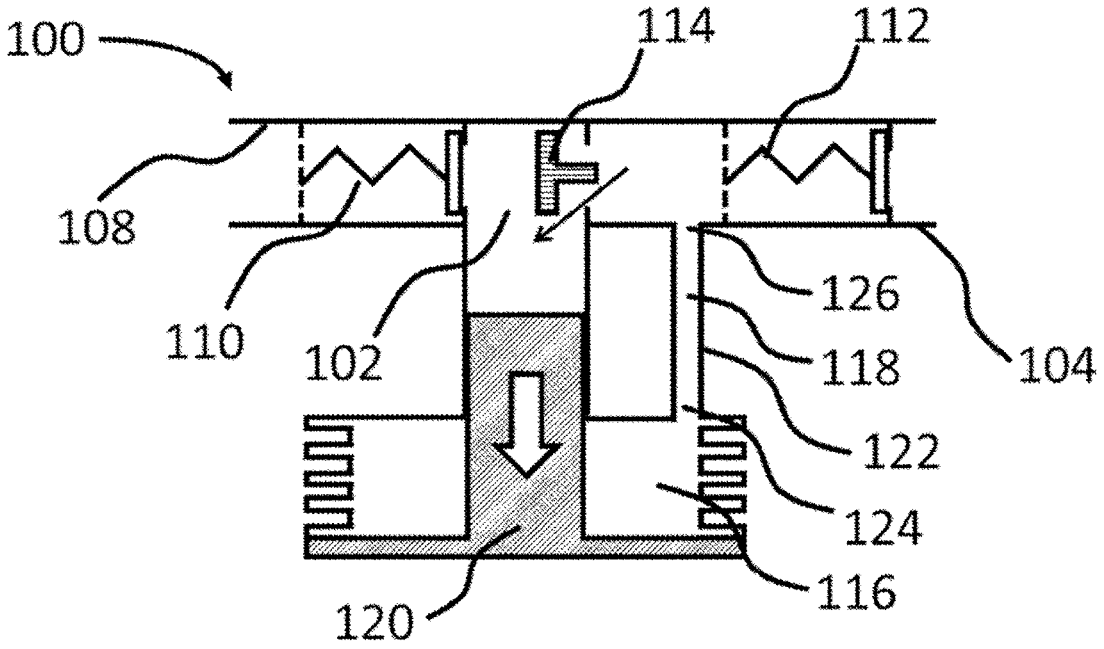
Figure 1F:
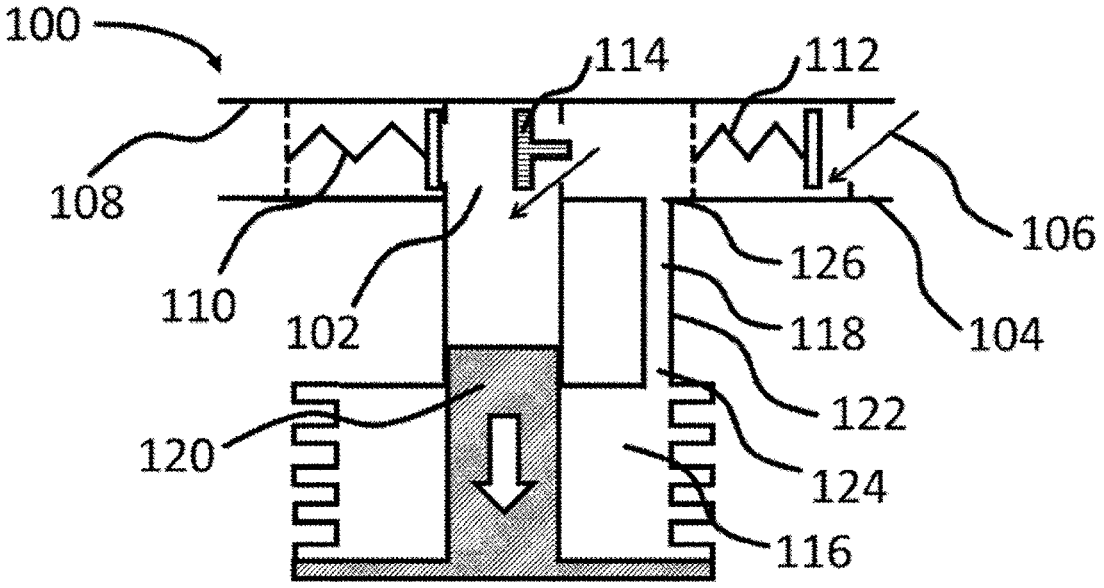

When the plunger or piston 120 moves down (suction stroke), the outlet check valve 110 closes and the digital inlet valve 114 opens and about 5 bar, for example, pressurized fluid fills the compression chamber 102, as shown in FIG. 1E. Then the suction process begins again to refill the manifold 118 and the variable volume chamber 116 and the compression chamber 102, as shown in FIG. 1F. After this, the process of FIGS. 1B to 1F as described above is repeated. In this way, reduction of a necessary feeding pressure for the high pressure pump 100 can be achieved. That is, an additional pump or a pre-supply pump to feed the fluid 106 into the high pressure pump 100 may be omitted or the power consumption of the additional pump or the pre-supply pump can be reduced.

Advantageously, the bottom part of the plunger or piston 120 may be integrated into the bottom part of the variable volume chamber 116. This allows for preventing the fluid from leaking to a cam side and/or lubricant from leaking from the cam side into the fluid.

In addition, the variable volume chamber 116 allows for improvement of contacting the cam with the bottom part of the variable volume chamber 116, since the variable volume chamber 116 acts like a spring. Therefore, a spring for the plunger or piston 120 may be omitted.

Furthermore, since the variable volume chamber 116 functions as a spring, a periodic pressure pulsation can be suppressed and stabilized. The pulsation is caused by a periodic fluid flow created by plunger or piston 120 pumping strokes and an actuation of the digital inlet valve 114. Therefore, a damper membrane may be omitted.

The variable volume chamber 116 advantageously comprises, or consists of a bellows. In that case, the variable volume chamber 116 expands or shrinks flexibly in accordance with the movement of the plunger or piston 120. The bellows is made preferably of a metal such as a steel or the like, or a plastic material such as an Aramide, in particular PPTA or the like. This may be advantageous since the bellow can be light in weight.

As shown in FIGS. 1A to 1F, the manifold 118 comprises a conduit 122, the conduit 122 having a first end 124 fluidically connected to the variable volume chamber 116 and a second end 126 fluidically connected between the inlet check valve 112 and the digital inlet valve 114. Therefore the compression chamber 102 and the variable volume chamber 116 are fluidically connected through the digital inlet valve 114.

The manifold 118 may comprise at least two separate conduits 122. This is advantageous for a smooth fluid exchange between the compression chamber 102 and the variable volume chamber 116 through the digital inlet valve 114.

Figure 2:
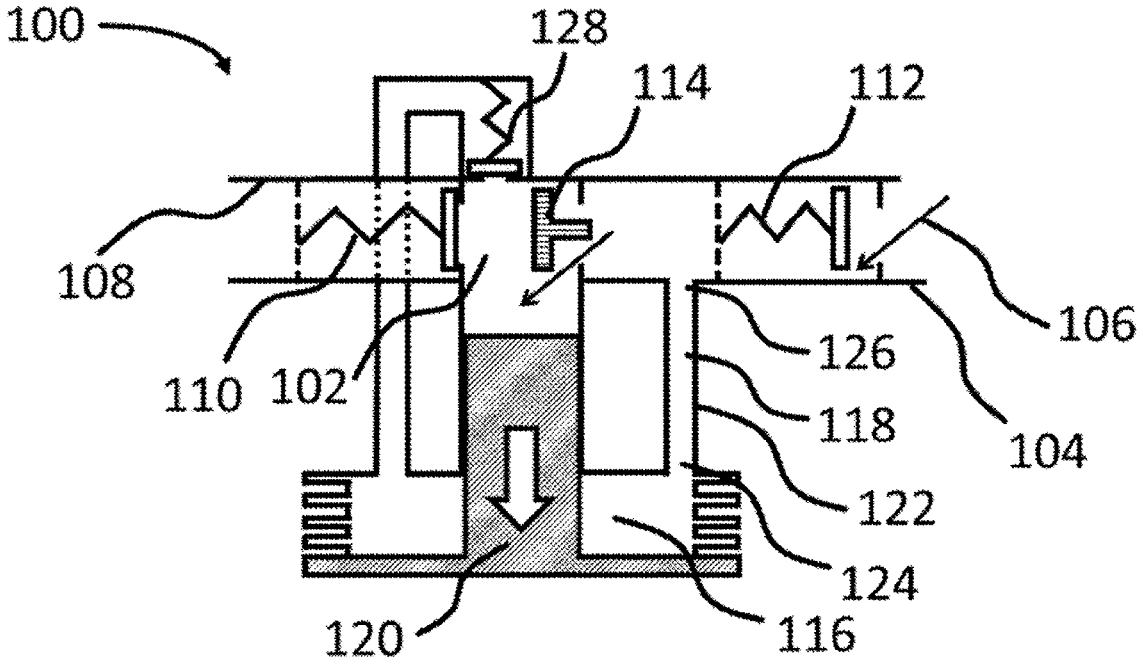
FIG. 2 is a schematic drawing of a high pressure pump comprising a safety valve in accordance with an embodiment.

As shown in FIG. 2, the pump 100 may further comprise a safety valve 128 preferably between the compression chamber 102 and the variable volume chamber 116. Alternatively, the safety valve 128 may be connected between the compression chamber 102 and any other part of the low pressure side, e.g. the manifold 118. If an overboost occurs in the compression chamber 102, the overboost can be released into the variable volume chamber 116 and the pressure in the compression chamber 102 can be kept within desired pressure levels. Because the variable volume chamber 116 has low pressure of up to 5 bar and spring and/or cushion like features, it may absorb the shock caused by sudden pressure changes.

Figure 3:
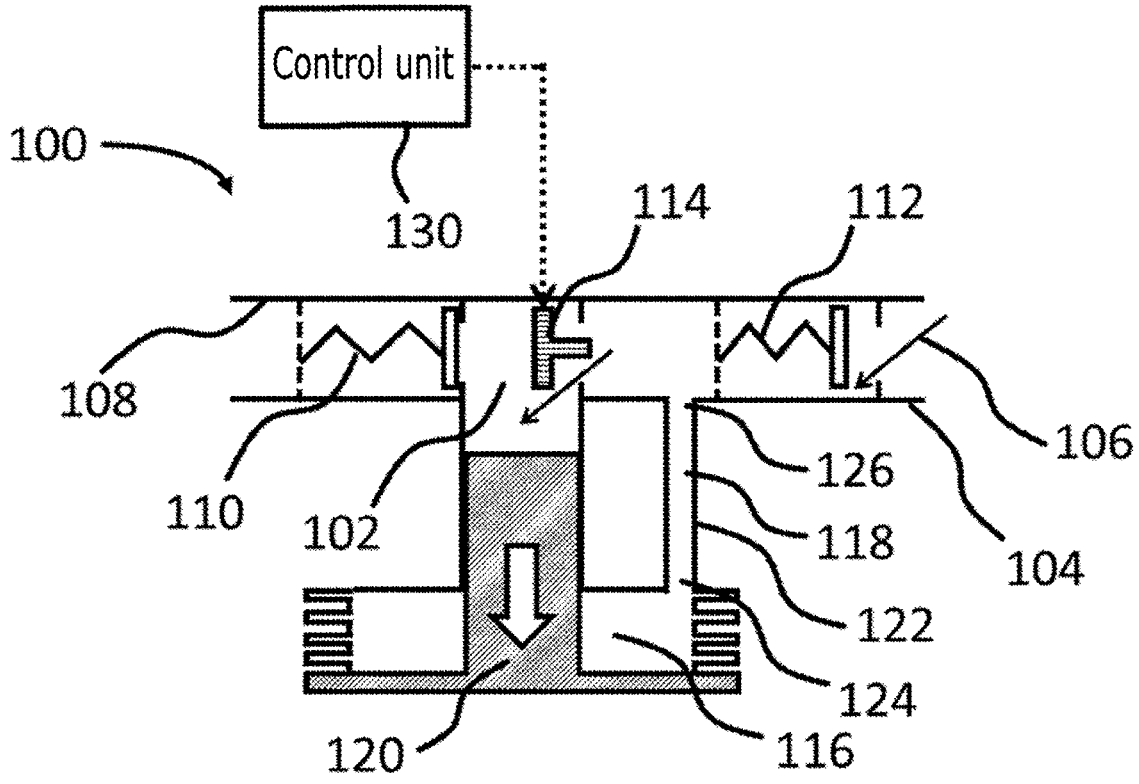
FIG. 3 is a schematic drawing of a high pressure pump comprising a control unit in accordance with an embodiment.

As shown in FIG. 3, the pump 100 further comprises a control unit 130 to provide electrical control of the digital inlet valve 114. This control unit 130 may be an engine control unit.

Figure 4:
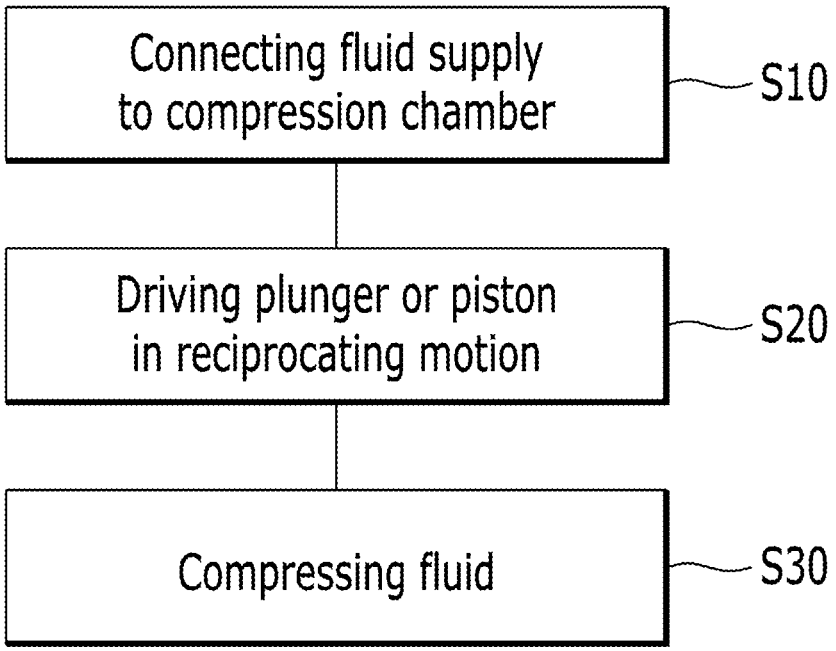
FIG. 4 is a schematic flow diagram illustrating step of compressing a fluid in accordance with an embodiment.
Figure 5A:
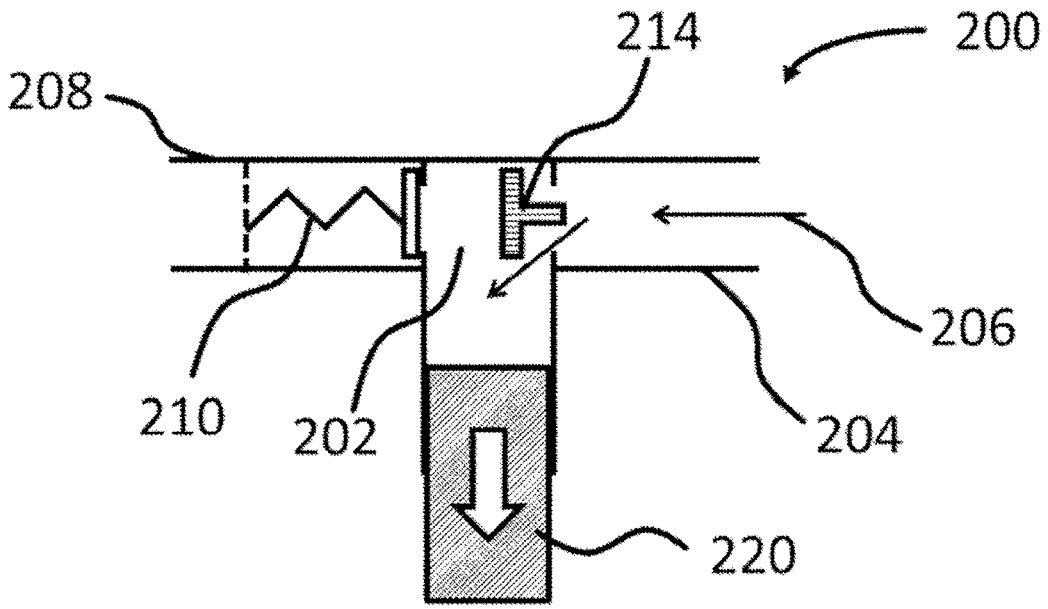
FIG. 5A (Prior Art)
FIGS. 5A, 5B and 5C are schematic drawings of a prior art high pressure pump.
Figure 5B:
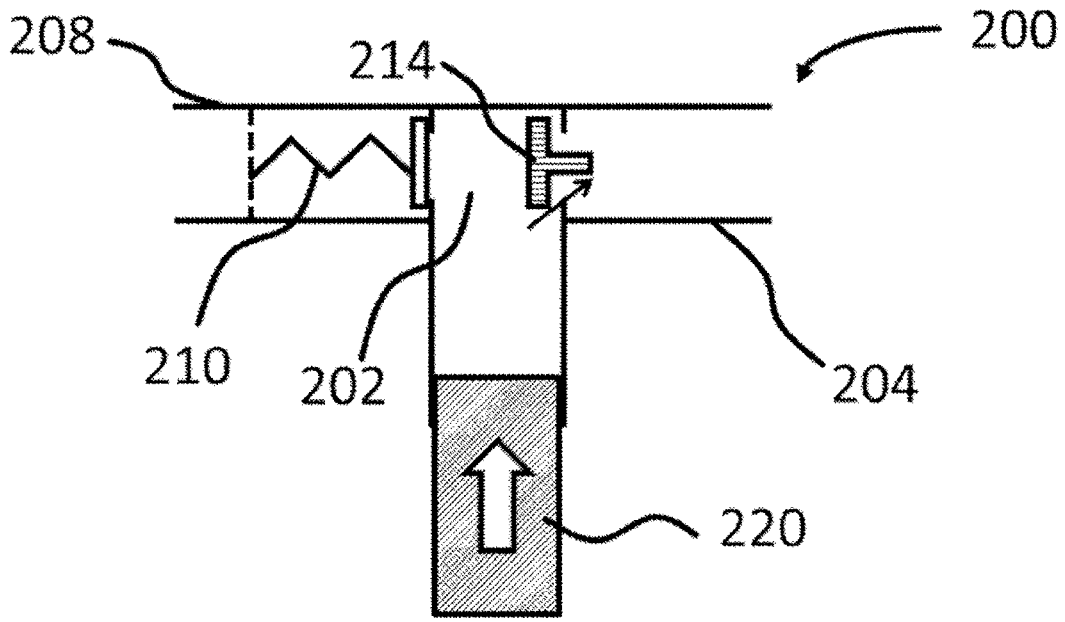
FIG. 5B (Prior Art)
Figure 5C:
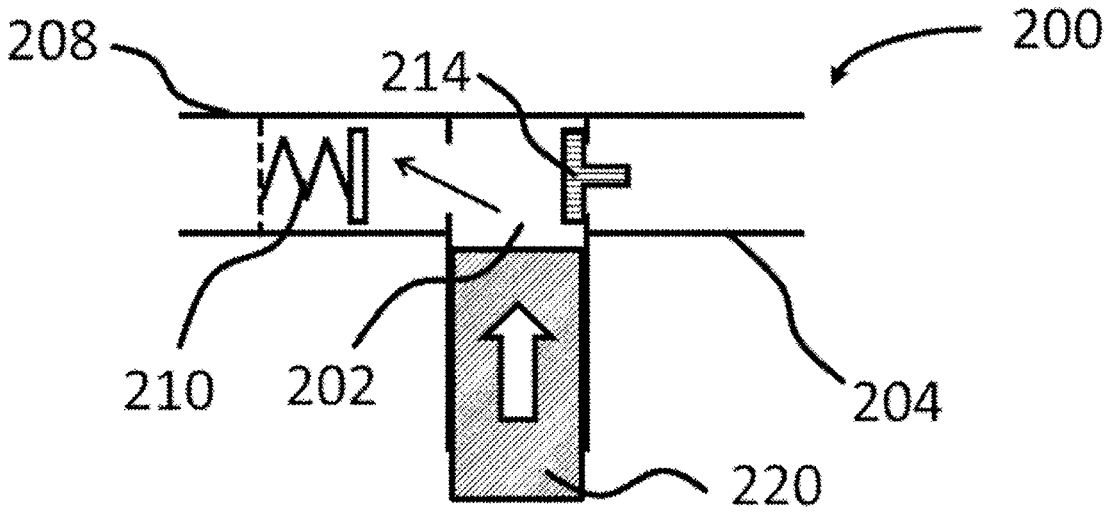
FIG. 5C (Prior Art)

FIG. 4 shows a flow diagram illustrating a method of compressing a fluid 106, the method comprising connecting S10 a fluid supply to a compression chamber 102, the compression chamber 102 having an inlet 104, an outlet 108, an inlet check valve 112 and a digital inlet valve 114. The compression chamber 102 is connected to a variable volume chamber 116 through a manifold 118 and the digital inlet valve 114. The method further includes driving S20 a plunger or piston 120 in a reciprocating motion, e.g. into and out of the compression chamber 102, and compressing S30 the fluid 106 in the compression chamber 102 and the variable volume chamber 116 by the plunger or piston 120 such that compressed fluid 106 is discharged from the compression chamber 102 through the outlet 108. The variable volume chamber 116 acts like a low pressure pump by changing the volume in accordance with the movement of the plunger or piston 120.

The method of compressing a fluid 106 may further include providing a safety valve 128 between the compression chamber 102 and the variable volume chamber 116 or between the compression chamber 102 and the manifold 118, and releasing an overboost into the variable volume chamber 116 or the manifold 118 by the safety valve 128 if the overboost occurs. Therefore overboost in the compression chamber 102 can be prevented and the reliability of the high pressure pump 100 can be improved using the safety valve 128.

The method of compressing a fluid 106 may also include controlling the digital inlet valve 114 electrically. The digital inlet valve 114 may be solenoid valve.

In the method of compressing a fluid 106, feeding pressure of the fluid supply is preferably less than 1 bar. As explained using FIGS. 1A to 1F, the variable volume chamber 116 needs only low pressure feed. Thus an additional pump or a pre-supply pump to feed the fluid into the high pressure pump 100 can be omitted or the power consumption of the additional pump or the pre-supply pump can be reduced.

In the method of compressing a fluid 106, the flow rate of the fluid from the supply may be less than 100 liters per hour (L/h). The variable volume chamber 116 needs only low pressure feed with low flow rate. Therefore an additional pump or a pre-supply pump to feed the fluid into the high pressure pump 100 may be omitted or the power consumption of the additional pump or the pre-supply pump can be reduced.

While a number of exemplary aspects have been discussed above, those of skill in the art will recognize that still further modifications, permutations, additions and sub-combinations thereof of the disclosed features are still possible. It is therefore intended that the following appended claims and claims hereafter introduced are interpreted to include all such modifications, permutations, additions and sub-combinations as are within their true spirit and scope.

The invention claimed is:

1. A high pressure pump comprising:

a compression chamber having an inlet for connecting to a fluid supply to intake a fluid, and an outlet;

an inlet check valve between the compression chamber and the inlet;

a digital inlet valve between the compression chamber and the inlet check valve;

a variable volume chamber connected to the compression chamber through a manifold and the digital inlet valve; and a plunger or piston configured to compress the fluid in the compression chamber and the variable volume chamber, wherein a bottom part of the plunger or piston is integrated into a bottom part of the variable volume chamber such that the bottom part of the variable volume chamber moves together with the bottom part of the plunger or piston;

wherein the variable volume chamber comprises a bellows integrated into the bottom part of the variable volume chamber and the bottom part of the plunger or piston; and wherein the high pressure pump further comprises a line directly connecting the compression chamber with the variable volume chamber or the manifold, and a safety valve selectively opening or closing the line to prevent overboost in the compression chamber.

2. The pump of claim 1, wherein the bellows is made of a metal or a plastic material.

3. The pump according to claim 1, wherein the manifold comprises a conduit, the conduit having a first end fluidically connected to the variable volume chamber and a second end fluidically connected between the inlet check valve and the digital inlet valve.

4. The pump according to claim 1, wherein the manifold comprises at least two separate conduits.

5. The pump according to claim 1, further comprising a control unit to provide electrical control of the digital inlet valve.

* * * * *